US006483053B2

(12) United States Patent
Kajio et al.

(10) Patent No.: US 6,483,053 B2
(45) Date of Patent: Nov. 19, 2002

(54) LOCK SWITCH APPARATUS

(75) Inventors: Hiroyuki Kajio, Kyoto (JP); Hidemitu Takenaka, Kyoto (JP); Yoshihito Koshiba, Kyoto (JP); Mitumi Kobayashi, Kyoto (JP); Masaharu Hibi, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/801,865

(22) Filed: Mar. 9, 2001

(65) Prior Publication Data

US 2001/0032778 A1 Oct. 25, 2001

(30) Foreign Application Priority Data

Mar. 15, 2000 (JP) ..... 2000-072875

(51) Int. Cl.[7] ..... H01H 27/00; H01H 1/52

(52) U.S. Cl. ..... 200/43.07; 200/43.04; 200/61.62; 200/318

(58) Field of Search ..... 200/17 R, 43.04, 200/43.07, 43.09, 43.16–43.22, 61.62–61.69, 318–326, 573

(56) References Cited

U.S. PATENT DOCUMENTS 5,464,954 A * 11/1995 Kimura et al. ..... 200/43.04
5,584,378 A * 12/1996 Wecke et al. ..... 200/43.04
5,777,284 A * 7/1998 Mohtasham ..... 200/318
5,861,786 A * 1/1999 Laveau ..... 335/132
5,909,166 A * 6/1999 Wecke et al. ..... 335/177

* cited by examiner

*Primary Examiner*—Michael Friedhofer
(74) *Attorney, Agent, or Firm*—Foley & Lardner

(57) ABSTRACT

A lock switch apparatus comprises: a key insertion hole 7; a detection switch unit 9 for detecting the insertion of an operation key 2 in the key insertion unit 7; a lock unit 11 for locking the operation key 2 when the operation key 2 is inserted in the key insertion hole 7; and a lock detection unit 13 for detecting the operation state of the lock unit 11. The lock unit 11 is configured so that the operation key 2 is locked by the attraction of a solenoid 12, a movable system of a solenoid-side movable portion is configured by providing an associatively movable portion which moves in association with the solenoid-side movable portion with respect to the solenoid-side movable portion of the solenoid 12, and vibration/impact absorbing means 14 is provided to provide a balance state of operating forces applied to the movable system. Thereby, there can be provided a lock switch capable of preventing a malfunction of switch signal due to an inertia force of the solenoid-side movable portion of the solenoid and capable of being made small in size.

14 Claims, 13 Drawing Sheets

(1)

(2)

LOCK SWITCH APPARATUS

CROSS-REFERENCES TO RELATED APPLICATION

This application claims all benefits accruing 35 U.S.C 119 from the Japanese Patent Application No. 2000-72875, filed on Mar. 15, 2000.

BACKGROUND OF THE INVENTION

1. Field of the Invention

The present invention relates to a lock switch apparatus used as a safety door switch and the like.

2. Description of the Related Art

A safety door switch is mounted on a safety door for a machine and a door for a protective fence to prevent an accident caused by an inadvertent operation or accidental erroneous operation on various types of machine tools and industrial machines.

The safety door switch serves as an interlocking switch of a machine tool. For example, an operation key is installed on the door side and a switch body is installed on the fixed frame side of a doorway. When the door is closed, the operation key is inserted in the switch body so that an internal switch is turned on, whereby a drive start state is established. Inversely, by performing an operation for opening the door, that is, by removing the operation key from the switch body to turn off the internal switch, the machine tool is placed in the stopped state.

Generally, the lock switches are of two types: a mechanical lock type and a solenoid lock type. A key switch body of a lock switch S of a mechanical lock type has, as shown in FIG. 18(1), a head unit 80', a detection switch unit 81, a lock unit 82 for locking the detection switch unit 81 in an on state, a solenoid 83 for releasing a lock set by the lock unit 82, and a switch unit 83-1 for detecting the release of lock effected by the solenoid 83.

As shown in FIG. 18(2), by inserting an operation key 76', a lock of a cam 84 is released, and the cam 84 is turned. Thereby, a second plunger 86, which is connected to a first plunger 85 being in slidable contact with the cam 84, is moved toward a head 80' by the urging force of a return spring 70'. As a result, a contact face 86A at the end of the second plunger 86 retracts from a plunger guide portion 88 into a guide wall portion 71.

Thus, the second plunger 86 is placed in a state of moving to the maximum. In the detection switch unit 81, therefore, a movable contact 87*a* of a first movable element 87 comes into contact with a fixed contact 89*a* of a first fixed terminal 89, whereby a first switch 90 is placed in an on state. Also, a movable contact 91*a* of a second movable element 91 is separated from a fixed contact 92*a* of a second fixed terminal 92, whereby a second switch 93 is placed in an off state. Thereby, it is verified that the detection switch unit 81 is operated.

In this case, a third plunger 96 of the lock unit 82 is advanced by the urging force of a locking spring 97, so that the third plunger 96 comes into contact with the contact face 86A at the end of the second plunger 86, by which the detection switch unit 81 is locked in an on state.

As shown in FIG. 18(3), the solenoid 83 is energized to retract a fourth plunger 94 connected to an iron core member 83*a* and thereby to turn a lever 95 around the turning center P, by which the third plunger 96 is moved against the locking spring 97. Thereby, the third plunger 96 is removed from the contact face 86A at the end of the second plunger 86 to release the lock of the detection switch unit 81.

In this case, by the movement of the fourth plunger 94, in the switch unit 83-1, a movable contact 98*a* at both ends of a movable element 98 is separated from a fixed contact 99*a* of a fixed terminal 99, so that a switch-off state is established. Therefore, since the switch unit 83-1 is placed in a switch-off state, the release of lock effected by the solenoid 83 is detected.

Also, by removing the operation key 76', the cam 84 is pulled by means of a transverse member 77*a* of the operation key 76' to turn the cam 84 reversely. By the reverse turning of the cam 84, the second plunger 86, which is connected to the first plunger 85 being in slidable contact with the cam 84, is moved to the direction opposite to the head 80' against the return spring 87, so that the contact face 86A at the end of the second plunger 86 projects into the plunger guide portion 88.

In the detection switch unit 81, the movable contact 87*a* of the first movable element 87 is separated from the fixed contact 89*a* of the first fixed terminal 89, so that the first switch 90 is placed in an off state. Also, the movable contact 91*a* of the second movable element 91 comes into contact with the fixed contact 92*a* of the second fixed terminal 92, so that the second switch 93 is placed in an on state.

As shown in FIGS. 19(1), 19(2) and 19(3), a lock switch S-1 of a solenoid lock type is different from the lock switch S of a mechanical lock type in that an unlocking spring 97-1 is disposed in place of the locking spring 97 to release the lock of the third plunger 96 in the lock unit 82. In this lock switch of a solenoid lock type, when the solenoid 83 is in an off state, a lock is not set, and only when the solenoid 83 is in an on state, a lock is set as shown in FIG. 19(3). Other configurations are the same as those of the lock switch S of a mechanical lock type.

However, the above-described conventional lock switch apparatus has a construction such that the third plunger 96 is connected to the fourth plunger 94, which is connected to the iron core member 83*a* of the solenoid 83, via the lever 95. Therefore, in order for the solenoid 83 to develop an attraction, a large-sized solenoid 83 is needed, which leads to an increased size and cost. Also, in the case where a vibration or impact is applied to the switch body, if the iron core weight increases in the large-sized solenoid 83, the iron core is moved under the influence of an inertia force, easily causing a malfunction of switch signal, which presents a problem in that a malfunction of the apparatus occurs.

Also, in the case of the lock switch S-1 of a solenoid lock type, since a lock must be set during the time when the apparatus is operated, the solenoid 83 must always be energized during this time, so that electric power is continuously consumed, which presents a problem in that the equipment cost increases.

The present invention has been made paying attention to the above problems, and accordingly an object thereof is to provide a lock switch apparatus in which a small-sized solenoid can be used, so that the outside size of a switch can be decreased, whereby handling by the user can be made easy.

BRIEF SUMMARY OF THE INVENTION

The present invention provides a lock switch apparatus comprising: a key insertion unit; a detection switch unit for detecting the insertion of an operation key in the key insertion unit; a lock unit for locking the operation key when the operation key is inserted in the key insertion unit; and a lock detection unit for detecting the operation state of the lock unit, wherein the detection switch unit has a plunger which is moved by the insertion of the operation key in the key insertion unit to operate a switch element, the lock unit has a slide lock member for locking the plunger by the movement thereof and a solenoid for operating a solenoid-side movable portion by being energized, the solenoid-side movable portion of the solenoid is connected to the slide lock member by a lever having a turning center in an intermediate portion thereof, and the slide lock member is moved at the ratio of the lever with respect to the operation of the solenoid-side movable portion, whereby the plunger is locked.

By the above-described configuration, the plunger can be locked by moving the slide lock member at the ratio of the lever with respect to the operation of the solenoid-side movable portion. Therefore, the slide lock member can be moved by using the solenoid-side movable portion in a zone in which the attraction of the solenoid is large.

Therefore, a small-sized solenoid can be used, so that the outside size of the lock switch apparatus can be decreased, whereby a switch capable of being handled easily by the user can be realized.

Also, the present invention provides a lock switch apparatus comprising: a key insertion unit; a detection switch unit for detecting the insertion of an operation key in the key insertion unit; a lock unit for locking the operation key when the operation key is inserted in the key insertion unit; and a lock detection unit for detecting the operation state of the lock unit, wherein the lock unit is configured so that the operation key is locked by the attraction of a solenoid, a movable system of a solenoid-side movable portion is configured by providing an associatively movable portion which moves in association with the solenoid-side movable portion with respect to the solenoid-side movable portion of the solenoid, and vibration/impact absorbing means is provided to provide a balance state of operating forces applied to the movable system. By the above-described configuration, the balance of the operating forces applied to the movable system is maintained by the vibration/impact absorbing means. Therefore, when a vibration or impact is applied to the lock switch apparatus, the movable system does not move, and a malfunction of switch signal due to an inertia force of the movable system, especially, the solenoid-side movable portion of the solenoid can be prevented, and also the lock switch apparatus can be made small in size.

Also, in the lock switch apparatus in accordance with the present invention, the associatively movable portion of the vibration/impact absorbing means includes the slide lock member which moves in association with the solenoid-side movable portion of the solenoid at the ratio of a lever, and the travel amount of the solenoid-side movable portion is amplified at the ratio of the lever to secure the travel amount of the slide lock member.

By the above-described configuration, the travel amount of the slide lock member can be secured by amplifying the amount of travel of the solenoid-side movable portion caused by the attraction of the solenoid at the ratio of the lever. Therefore, the slide lock member can be moved by using the solenoid-side movable portion in a zone in which the attraction of the solenoid is large.

Thereupon, a small-sized solenoid can be used, so that the outside size of the lock switch apparatus can be decreased, whereby a switch capable of being handled easily by the user can be realized.

Also, in the lock switch apparatus in accordance with the present invention, the lock switch apparatus has lock holding force securing means for holding and securing a lock holding force of the lock unit by mechanical means without dependence on the attraction of the solenoid.

Also, two stationary points of the slide lock member at the time when the solenoid is de-energized are provided in the travel direction of the slide lock member, and what we call an alternate operation, in which the stationary points are changed over alternately when the solenoid is turned on, off, and on, is performed, so that a lock state of the operation key is established at a first stationary point, and an unlock state is established at a second stationary point.

By the above-described configuration, the alternate lock state, that is, a mechanically locked state can be established. Therefore, power consumption during the operation of the apparatus can be eliminated, which contributes to power saving of the whole system. Also, the influence of deterioration in characteristics due to heat of the solenoid can be decreased, so that a switch with high reliability can be provided by being operated in a superior characteristic zone.

Also, in the lock switch apparatus in accordance with the present invention, the lock switch apparatus has compulsorily unlocking means for releasing lock hold caused by the lock holding force securing means by using mechanical means without dependence on the attraction of the solenoid.

By the above-described configuration, the lock can be released and the state can be returned from the alternate lock state, that is, the mechanically locked state to the initial state artificially without energizing the solenoid.

Also, in the lock switch apparatus in accordance with the present invention, the lock detection unit carries out the detection of a lock state caused by the attraction of the solenoid and a mechanical lock hold state independently of each other.

By the above-described configuration, the detection of the lock state caused by the attraction of the solenoid and the detection of the mechanical lock hold can be distinguished from each other, so that a difference in lock can be recognized by the user.

Also, in the lock switch apparatus in accordance with the present invention, the detection switch unit is disposed on one face of a base member, and the lock unit, the lock detection unit, and the vibration/impact absorbing means are disposed on the other face of the base member.

By the above-described configuration, the outside shape of the switch can be made square, so that a degree of freedom can be provided when the switch is installed.

BRIEF DESCRIPTION OF THE SEVERAL VIEWS OF THE DRAWINGS

FIG. 3(2) is a longitudinal sectional view of a detection switch unit of the lock switch apparatus shown in FIG. 1;

FIG. 9(2) is a view taken in the direction of the arrow T of FIG. 9(1);

FIG. 9(3) is a view taken in the direction of the arrow U of FIG. 9(1);

FIG. 11(2) is a view taken in the direction of the arrow V of FIG. 11(1);

FIG. 11(3) is a view taken in the direction of the arrow W of FIG. 11(1);

FIG. 16(2) is an explanatory view showing a first solenoid attracting state of the lock switch apparatus shown in FIG. 16(1);

FIG. 16(3) is an explanatory view showing an alternate lock state of the lock switch apparatus shown in FIG. 16(1);

FIG. 16(4) is an explanatory view showing a second solenoid attracting state of the lock switch apparatus shown in FIG. 16(1);

FIG. 17(2) is a perspective view, partially omitted, showing first and second solenoid attracting states of the lock switch apparatus shown in FIG. 17(1);

DETAILED DESCRIPTION OF THE INVENTION

An embodiment of a lock switch apparatus in accordance with the present invention will now be described with reference to the accompanying drawings.

Figure 1:
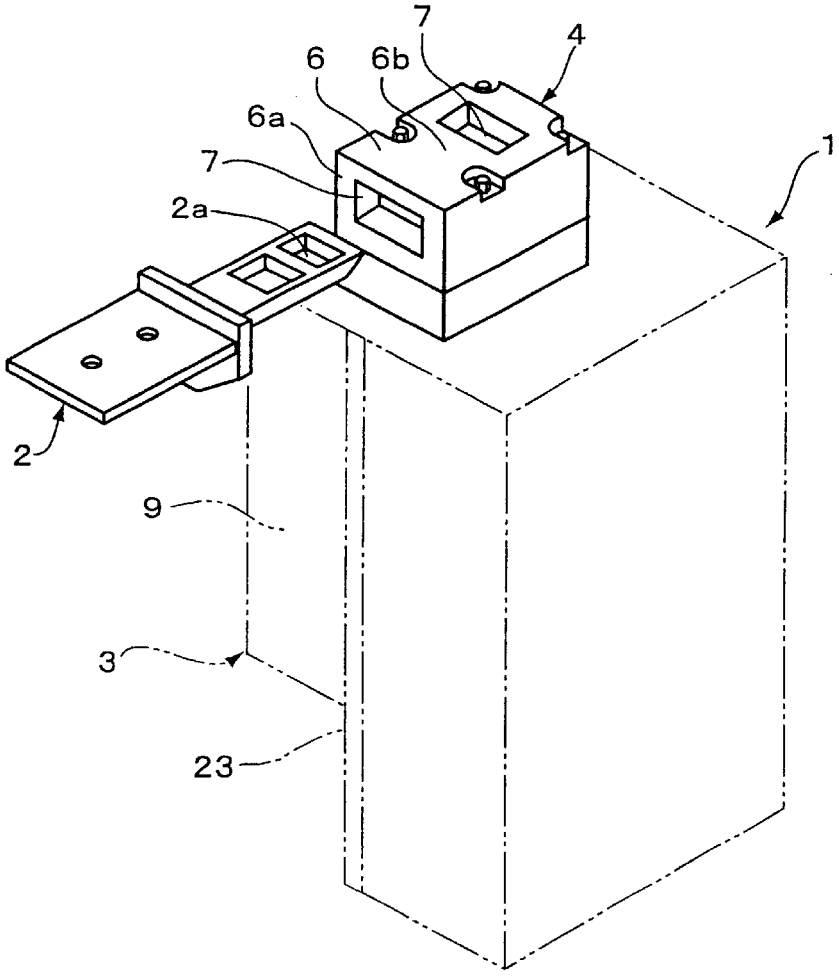
FIG. 1 is a perspective view of a head unit of a lock switch apparatus in accordance with the present invention.
Figure 2:
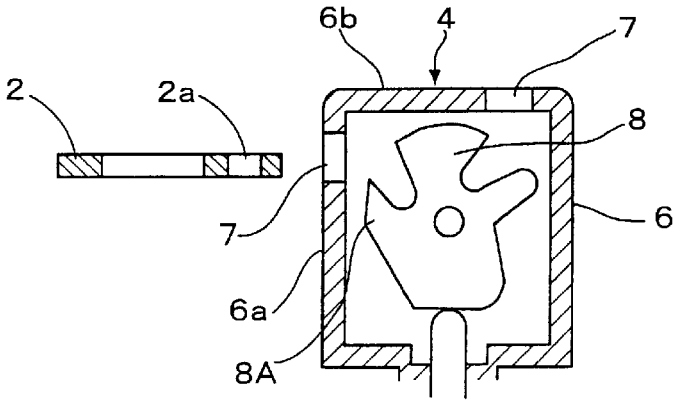
FIG. 2 is a longitudinal sectional view of a head unit of the lock switch apparatus shown in FIG. 1.
Figure 3:
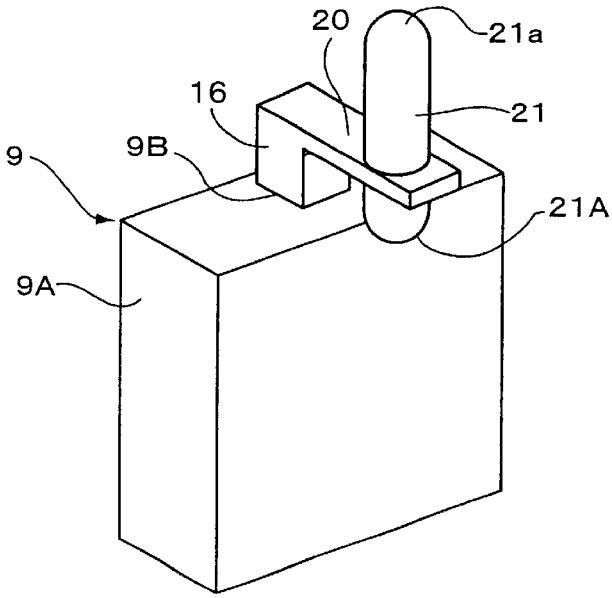
FIG. 3(1) is a perspective view of a detection switch unit of the lock switch apparatus shown in FIG. 1.
Figure 3:
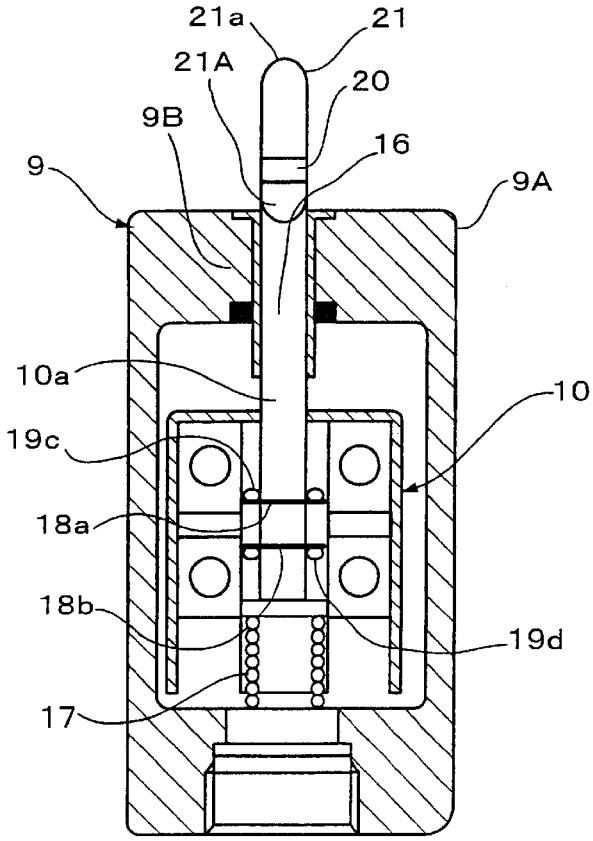
Figure 4:
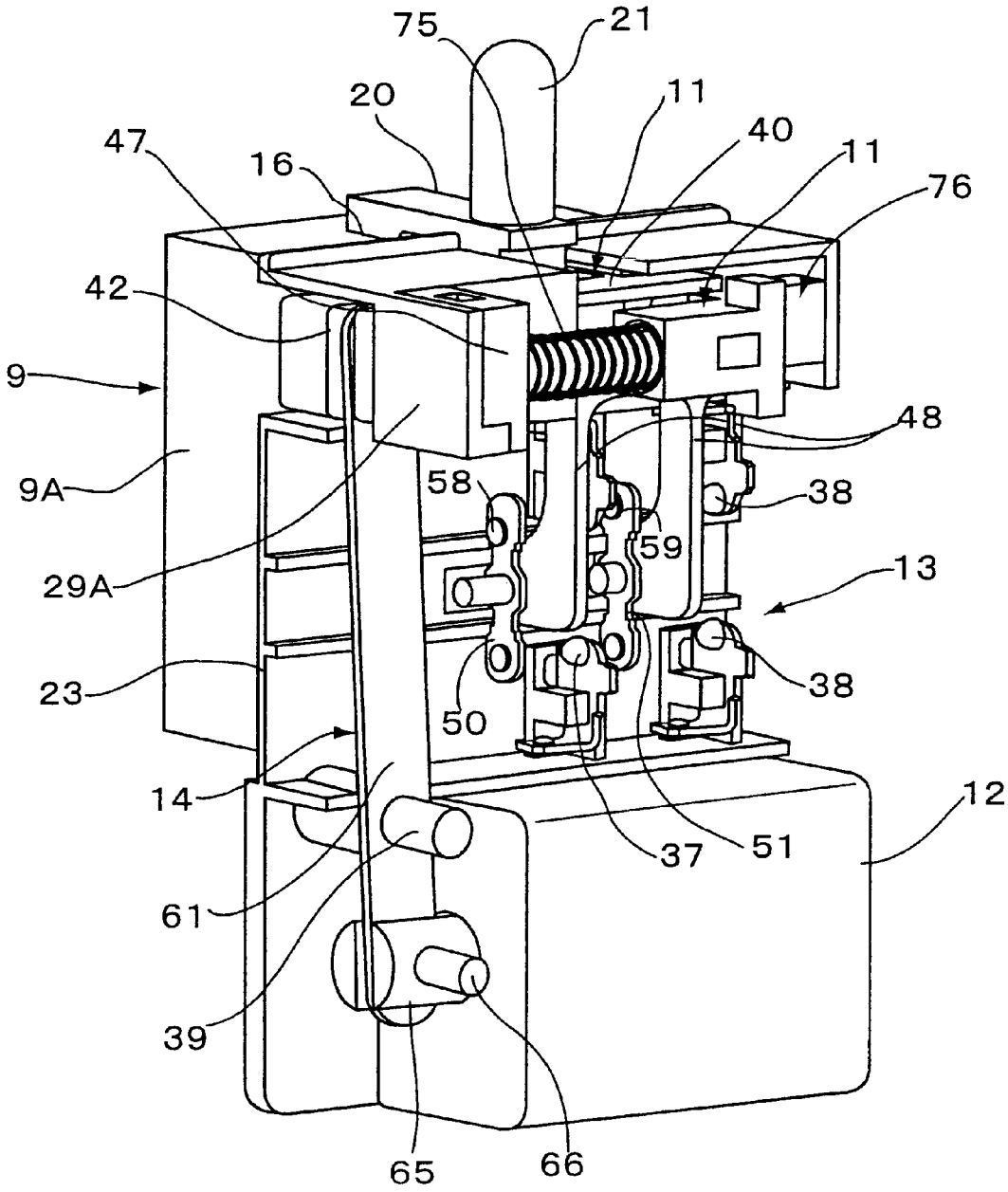
FIG. 4 is a perspective view, partially omitted, of a lock switch apparatus in accordance with the present invention.

FIG. 1 is a perspective view of a head unit of a lock switch apparatus in accordance with the present invention, FIG. 2 is a longitudinal sectional view of the head unit of the lock switch apparatus shown in FIG. 1, FIG. 3(1) is a perspective view of a detection switch unit of the lock switch apparatus shown in FIG. 1, FIG. 3(2) is a longitudinal sectional view of a detection switch unit of the lock switch apparatus shown in FIG. 1, and FIG. 4 is a perspective view, partially omitted, of the lock switch apparatus in accordance with the present invention.

As shown in FIG. 1, the lock switch apparatus in accordance with the present invention consists of a switch body 1 and an operation key 2. The switch body 1 is made up of a switch unit 3 and a head unit 4 that is fixed to the upper part of the switch unit 3 with screws and has a key insertion hole 7, which is a key insertion unit.

The switch unit 3 has a detection switch unit 9 for detecting the insertion of the operation key 2 in the key insertion hole 7, a lock unit 11 for locking the operation key 2 when the operation key 2 is inserted in the key insertion hole 7, a lock detection unit (lock detection switch unit) 13 for detecting the operation state of the lock unit 11, a vibration/impact absorbing mechanism 14, which is vibration/impact absorbing means, lock holding force securing means for holding and securing a lock holding force of the lock unit 11 by mechanical means without dependence on the attraction of a solenoid 12, and a compulsorily unlocking mechanism 76, which is compulsorily unlocking means, for releasing lock hold effected by the lock holding force securing means by using mechanical means without dependence on the attraction of the solenoid 12.

The head unit 4 has a head case 6 forming the outside shape thereof. On a side face 6*a* and the top face 6*b* of the head case 6 is formed a key insertion hole 7, and in the head case 6 is pivotally supported a cam 8.

Also, the operation key 2, which is inserted in and removed from the key insertion hole 7, has an engagement hole 2*a* engaging with a protrusion 8A of the cam 8, so that as the operation key 2 is inserted or removed, the cam 8 engaged with the engagement hole 2*a* is turned in the normal or reverse direction relatively.

The detection switch unit 9 has a switch case 9A as shown in FIGS. 3(1) and 3(2). At the top end of the switch case 9A is provided a plunger penetrating hole 9B, and a switch operating plunger 16 is mounted in the plunger penetrating hole 9B so as to be movable vertically. The plunger 16 is provided with an arm 20, which is bent at right angles to the plunger 16, in a portion where the plunger 16 projects above the plunger penetrating hole 9B. In the tip end portion of the arm 20 are provided a tip-end plunger 21 facing upward and a locking protrusion 21A facing downward.

The plunger 16 is configured so that a tip end portion 21*a* of the tip-end plunger 21 of the plunger 16 is brought into contact with the lower face of the cam 8 by an upward urging force given by a spring member 17. In the state in which the operation key 2 is removed, the tip end portion 21*a* of the tip-end plunger 21 is in contact with the arcuate outer peripheral face of the cam 8, and the plunger 16 is pressed down and displaced against the spring member 17. When the cam 8 is turned by the insertion of the operation key 2, the plunger 16 is urged by the spring member 17 so as to be displaced upward.

The lower end of the plunger 16 forms an activating portion 10*a* for activating a switching element 10. In the state in which the operation key 2 is removed and the plunger 16 is compulsorily displaced downward by the removal of the operation key 2, a movable element 18*a* is separated from a fixed contact 19*c* by the activating portion 10*a* of the plunger 16. In this state, a movable element 18*b* is in contact with a fixed contact 19*d*.

As shown in FIG. 4, the switch case 9A of the detection switch unit 9 is fixed to a base member 23. The base member 23 is provided with the lock unit 11, the solenoid 12 in the lock unit 11, the lock detection unit 13, the vibration/impact absorbing mechanism 14, the lock holding force securing means using an alternate mechanism 44, and the compulsorily unlocking mechanism 76, which is compulsorily unlocking means.

Figure 8:
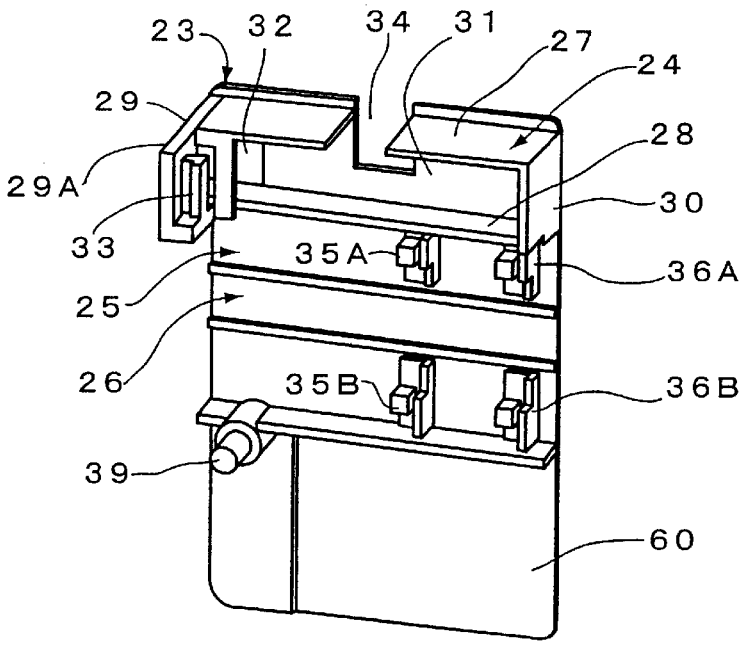
FIG. 8 is a perspective view of a base member.
Figure 9:
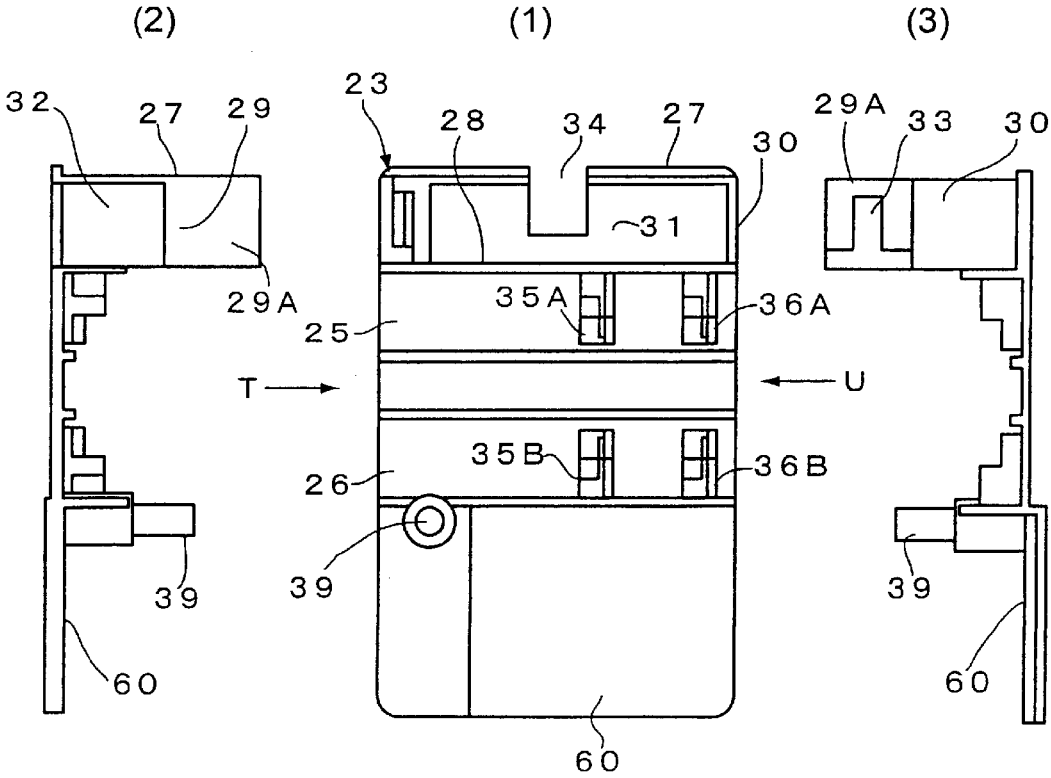
FIG. 9(1) is a front view of the base member shown in FIG. 8.

Specifically, as shown in FIGS. 8 and 9, the base member 23 is formed with a slide groove forming portion 24, fixed contact forming portions 25 and 26, and a solenoid mounting portion 60. The slide groove forming portion 24 is formed with a slide groove 31 surrounded by a ceiling 27, a bottom face 28 in parallel with the ceiling 27, and left and right side walls 29 and 30.

A notch 32 is formed ranging from a left-hand side portion of the base member 23 to the left side wall 29, and also an extension 29A is formed on the left side wall 29. On the inside of the extension 29A, an engagement protrusion 33 projects. Also, a notch 34 is formed ranging from a top portion of the base member 23 to the ceiling 27.

The fixed contact forming portion 25 is formed with a fixed contact mounting portion 35A and a fixed contact mounting portion 36A, which are arranged side by side. Also, the fixed contact forming portion 26 is formed with a fixed contact mounting portion 35B and a fixed contact mounting portion 36B, which are arranged side by side. In a left intermediate portion of the base member 23, a support shaft 39 projects. Also, the fixed contact mounting portions 35A and 35B are fitted with a first fixed contact 37, and the fixed contact mounting portions 36A and 36B are fitted with a second fixed contact 38 (see FIGS. 4 and 5).

Figure 10:
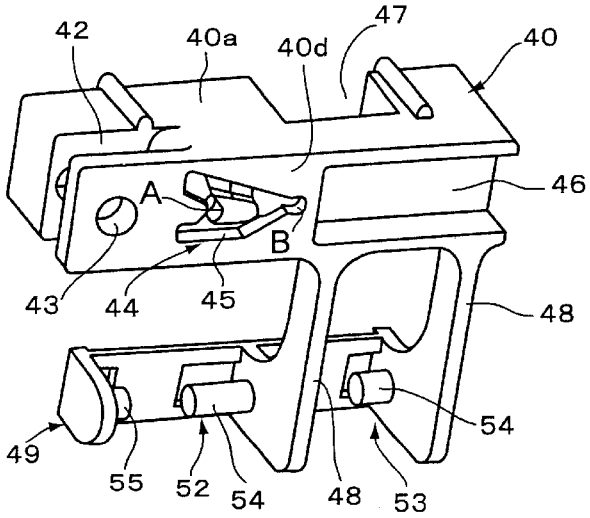
FIG. 10 is a perspective view of a slide lock member.
Figure 11:
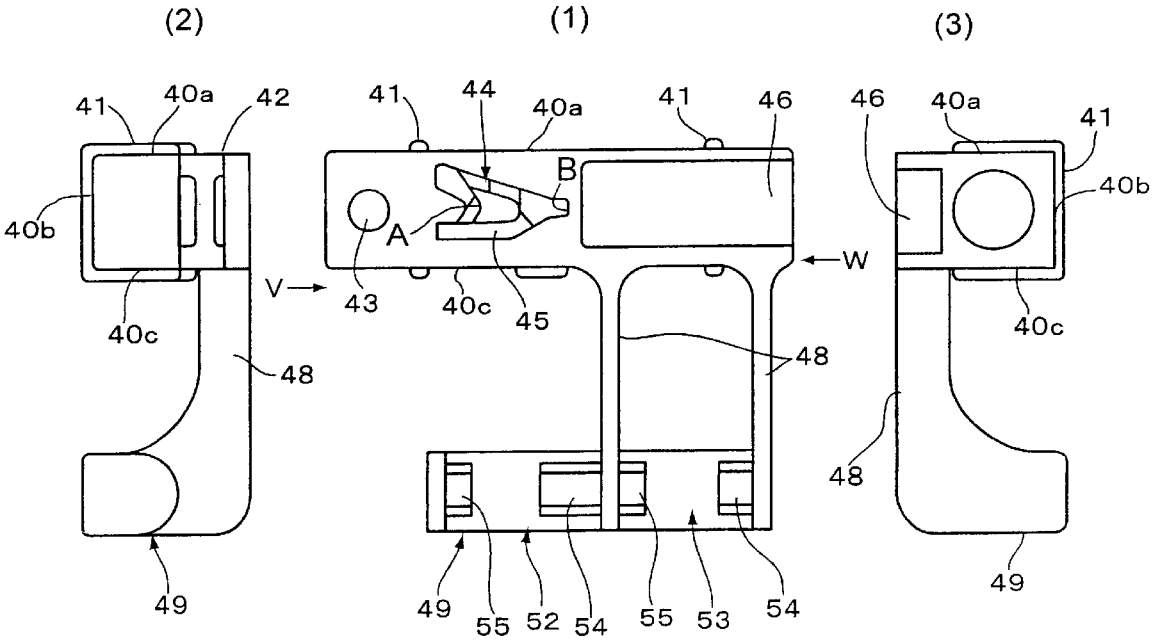
FIG. 11(1) is a front view of the slide lock member shown in FIG. 10.

In the slide groove 31 of the base member 23 is movably provided a slide lock member 40. The slide lock member 40 is formed with protrusion-like sliding portions 41 in the right and left portions, the sliding portions 41 extending from a top face 40*a* to a back face 40*b* to a bottom face 40*c* of the slide lock member 40 as shown in FIGS. 10 and 11. Also, in a left end portion of the slide lock member 40 is formed a fork-like lever bearing portion 42, and the lever bearing portion 42 is provided with a pin hole 43.

Also, on a front face 40*d* of the slide lock member 40 is formed a heart-shaped groove cam 45 of the alternate mechanism 44, which is located in an intermediate portion of the front face 40*d*. The groove cam 45 has a first stationary point A and a second stationary point B. On the front face 40*d* of the slide lock member 40 is formed a slide groove 46 extending from the right end of the front face 40*d* toward the groove cam 45. Also, on the back face 40*b* of the slide lock member 40 is formed an engagement recess 47 to the right.

Figure 5:
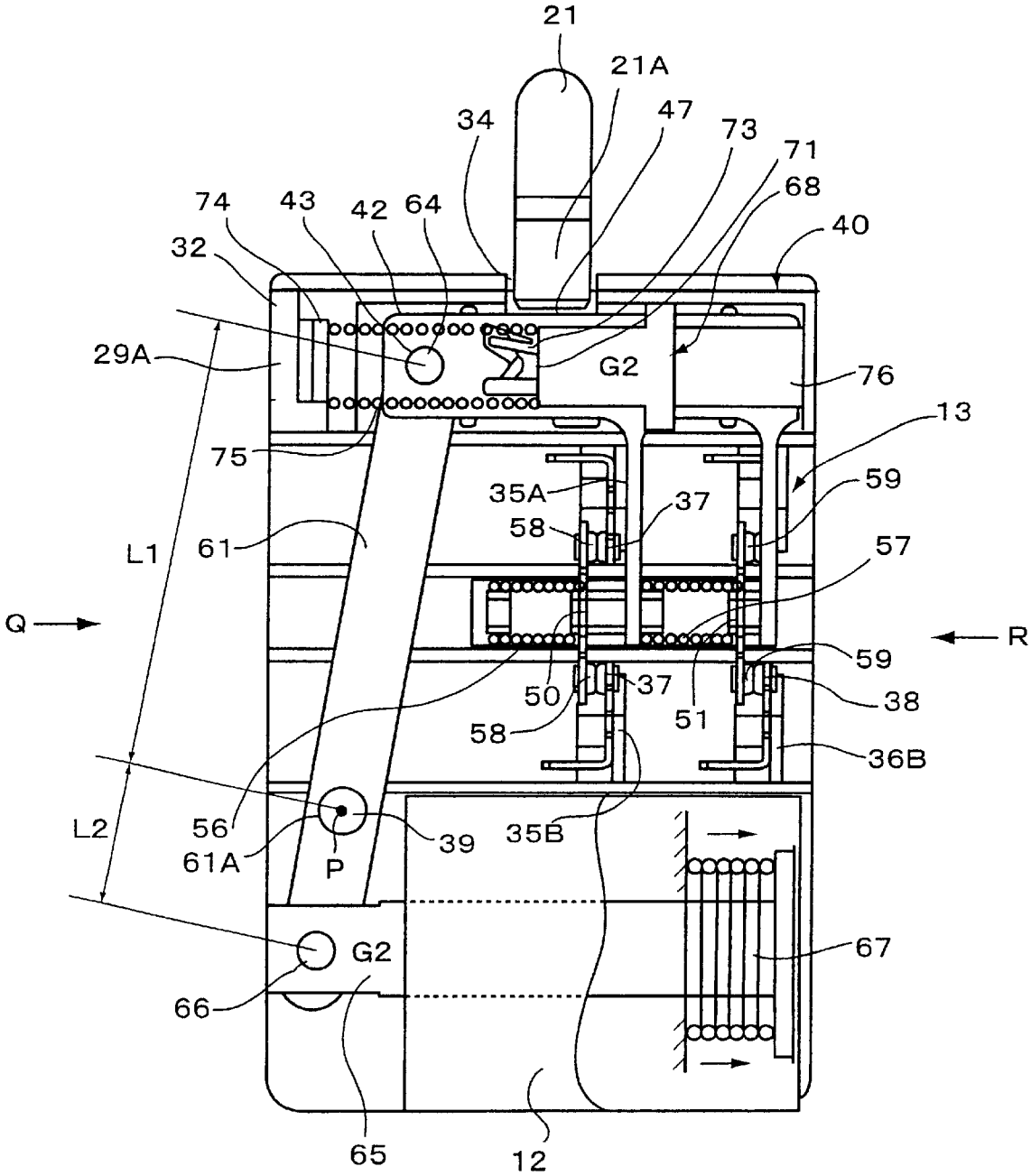
FIG. 5 is a front view, partially omitted, of the lock switch apparatus shown in FIG. 4.
Figure 6:
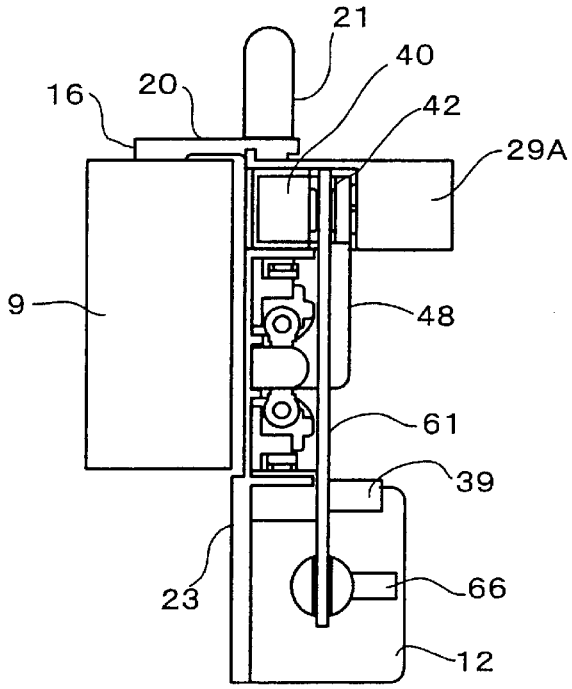
FIG. 6 is a view taken in the direction of the arrow Q of FIG. 5.
Figure 7:
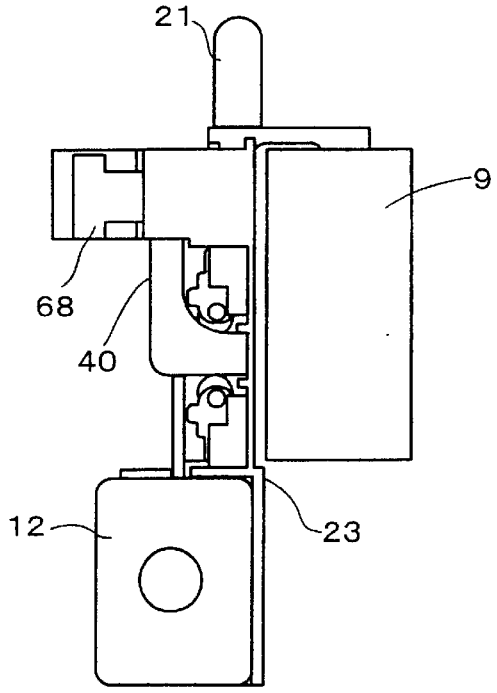
FIG. 7 is a view taken in the direction of the arrow R of FIG. 5.

The slide lock member 40 is provided with a movable contact holding portion 49 via an arm 48. The movable contact holding portion 49 is provided with a holing portion 52 for a first movable element 50 and a holding portion 53 for a second movable element 51. The holding portions 52 and 53 each have a holder 54 and a spring receiving portion 55. As shown in FIG. 5, the holder 54 of the holding portion 52 is slidably fitted with the first movable element 50, and the first movable element 50 is held by a holding spring 56 provided between the first movable element 50 and the spring receiving portion 55.

Also, as shown in FIG. 5, the holder 54 of the holding portion 53 is slidably fitted with the second movable element 51, and the second movable element 51 is held by a holding spring 57 provided between the second movable element 51 and the spring receiving portion 55. The first movable element 50 is provided with a first movable contact 58 which comes into contact with and is separated from the first fixed contact 37, and the second movable element 51 is provided with a second movable contact 59 which comes into contact with and is separated from the second fixed contact 38, by which the lock detection unit 13 is formed.

In the solenoid mounting portion 60 of the base member 23 is installed the solenoid 12 sideways. Also, on the support shaft 39 of the base member 23 is rotatably fitted a bearing hole 61A, which is the turning center P in an intermediate portion of a lever 61. In upper and lower end portions of the lever 61 are formed elongated holes 62 and 63, respectively, which are long in the axial direction of the lever 61 (see FIG. 16(1)).

An upper end portion of the lever 61 is inserted in the fork-like lever bearing portion 42 in the left end portion of the slide lock member 40, and a pin 64 inserted in the pin hole 43 in the lever bearing portion 42 penetrates the elongated hole 62. Thus, the upper end portion of the lever 61 is connected to the left end portion of the slide lock member 40 by the pin 64. Also, in the elongated hole 63 in the lower end portion of the lever 61, a pin 66 for an operation rod 65 of the solenoid 12 is inserted. The lower end portion of the lever 61 is connected to the operation rod 65 of the solenoid 12 by the pin 66. The operation rod 65 of the solenoid 12 is urged to the right by a return spring 67 when the solenoid 12 is de-energized.

Figure 12:
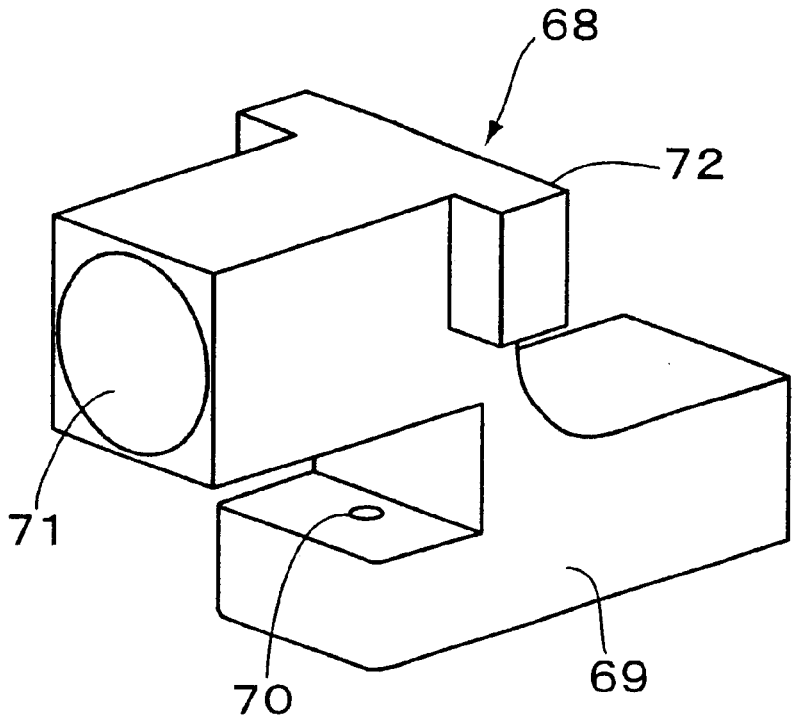
FIG. 12 is a perspective view of a movable element.

In the slide groove 46 in the slide lock member 40, a movable element 68 of the alternate mechanism 44 is provided. The movable element 68 has a slider portion 69 as shown in FIG. 12, and a lock pin insertion hole 70 is provided in a left end portion of the slider portion 69. Also, the slider portion 69 is provided with a spring receiving portion 71, and a right end portion of the spring receiving portion 71 forms a cam receiving face 72.

Figure 13:
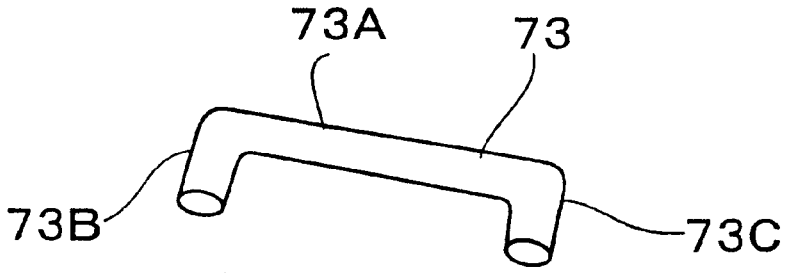
FIG. 13 is a perspective view of a lock pin.

A lock pin 73 of the alternate mechanism 44 has bent portions 73B and 73C at both ends of a straight portion 73A as shown in FIG. 13. The bent portion 73B on the left-hand side of the lock pin 73 is slidably inserted in the heart-shaped groove cam 45 provided in the slide lock member 40, and the bent portion 73C on the right-hand side of the lock pin 73 is rotatably inserted in the lock pin insertion hole 70 in the movable element 68, and the lock pin 73 is prevented from coming off by being held by a spring or the like.

Also, as shown in FIGS. 4 and 5, a spring receiving member 74 is provided on the extension 29A of the left side wall 29 of the base member 23 so as to engage with the engagement protrusion 33, and a spring member 75 is interposed between the spring receiving member 74 and the spring receiving portion 71 of the movable element 68, so that the movable element 68 is pushed to the right by the urging force of the spring member 75, and the bent portion 73B on the left-hand side of the lock pin 73 is inserted in the groove cam 45.

The groove cam 45 of the alternate mechanism 44 provided in the slide lock member 40, the movable element 68 of the alternate mechanism 44, the spring member 75 for urging the movable element 68, and the lock pin 73 of the alternate mechanism 44 constitute lock holding force securing means for holding and securing the lock holding force of the lock unit 11 by mechanical means without dependence on the attraction of the solenoid 12.

Figure 14:
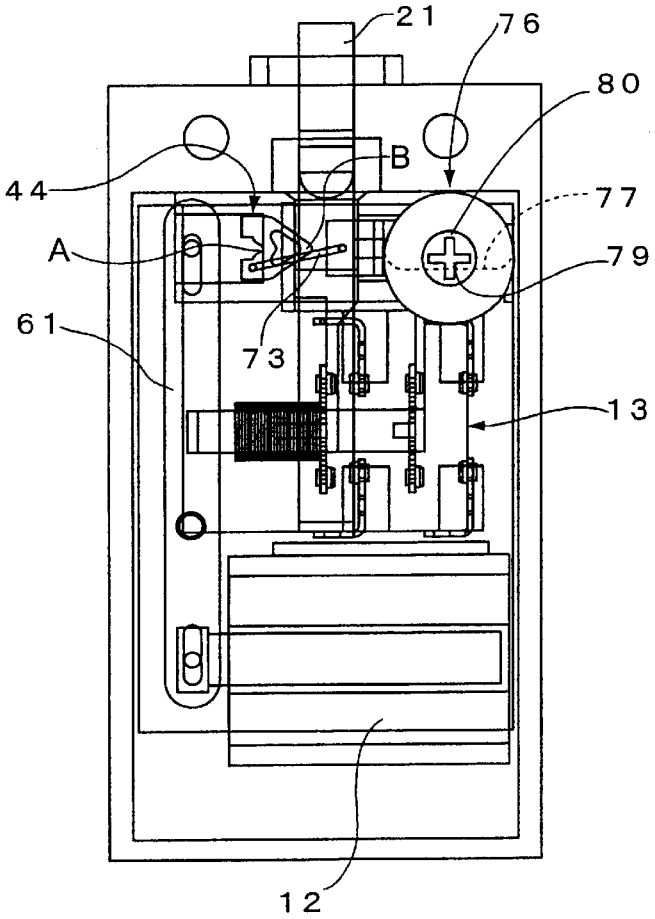
FIG. 14 is a front view, partially omitted, of a lock switch apparatus provided with unlocking means.
Figure 15:
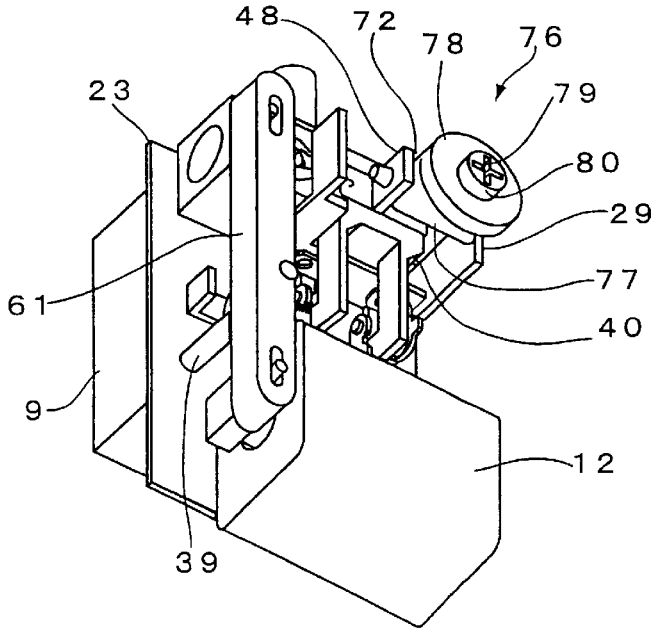
FIG. 15 is a perspective view, partially omitted, of a lock switch apparatus provided with unlocking means.

Also, as shown in FIGS. 14 and 15, the compulsorily unlocking mechanism 76 is disposed in a right end portion of the slide groove forming portion 24 of the base member 23. Specifically, the compulsorily unlocking mechanism 76 has a semi-circular cam member 77. To the cam member 77 is fixed a disk 78, and a protrusion 80 having a plus sign-shaped groove (may be a minus sign-shaped groove) 79 is provided in the center of the disk 78.

The compulsorily unlocking mechanism 76 is rotatably installed to the slide groove forming portion 24, and the cam member 77 is in a state of being held between the cam receiving face 72 of the movable element 68 and the right side wall 29 of the slide groove forming portion 24, so that the cam member 77 circumscribes the cam receiving face 72.

In the above-described lock switch apparatus, the slide lock member 40, the movable element 68 mounted on the slide lock member 40, the lock pin 73, and the like constitute an associatively movable portion. When the movement weight of the associatively movable portion is taken as G1, the movement weight of a solenoid-side movable portion, made up of a core (iron core portion) of the solenoid 12 and the operation rod 65 thereof, is taken as G2, a distance between the support shaft 39 of the lever 61 and the connection pin 64 of the slide lock member 40 is taken as L1, and a distance between the support shaft 39 of the lever 61 and the connection pin 66 of the operation rod 65 of the solenoid 12 is taken as L2, the balance between the operating forces described below is maintained, and vibration/impact absorbing means is constituted of these elements.

$$G1 \times L1 = G2 \times L2$$

Next, the operation of the lock switch apparatus constructed as described above will be described.

(Initial State)

For example, in a state in which the operation key 2 is mounted on the door side and the switch body 1 is mounted on the fixed frame side of the doorway, when the door is open, the operation key 2 has been removed from the switch body 1. In this case, the lock switch apparatus is in an initial state shown in FIGS. 16(1) and 17(1).

In this initial state, the tip end portion 21*a* of the tip-end plunger 21 of the plunger 16 is in contact with the arcuate outer peripheral face of the cam 8, and the plunger 16 is pressed down and displaced against the spring member 17.

Also, the solenoid 12 is not energized, and therefore the operation rod 65 connected to the core (iron core portion) of the solenoid 12 is pulled in by the spring 67 for solenoid. Thereupon, the slide lock member 40 is moved to the left via the lever 61.

As a result, the engagement recess 47 provided in the slide lock member 40 coincides with the notch 34 in the base member 23, and the locking protrusion 21A of the plunger 16 engages with the engagement recess 47 so as to be releasable from the notch 34. Also, the activating portion 10*a* of the plunger 16 is pressed down, so that the movable element 18*a* is separated from the fixed contact 19*c*, and the movable element 18*b* comes into contact with the fixed contact 19*d*, by which a switch off state is established.

In this initial state, the movable element 68 is pressed to the right by the spring force of the spring member 75, and the bent portion 73B on the left-hand side of the lock pin 73 is held at the second stationary point B of the groove cam 45.

Also, in the initial state, in the lock detection unit 13, the first movable contact 58 of the first movable element 50 is separated from the first fixed contact 37, and the second movable contact 59 of the second movable element 51 is separated from the second fixed contact 38 by the leftward movement of the slide lock member 40, so that the de-energized solenoid 12, that is, the unlocked state is detected.

(First Solenoid Attracting State)

When the door is closed, the operation key 2 is inserted in the switch body 1, and the cam 8 is turned by the insertion of the operation key 2, so that the plunger 16 moves upward.

When the plunger 16 moves upward, the locking protrusion 21A of the plunger 16 comes off from the engagement recess 47, and also the pressing-down of the activating portion 10*a* of the plunger 10 is released. Therefore, the movable element 18*a* comes into contact with the fixed contact 19*c*, and the movable element 18*b* comes into contact with the fixed contact 19*d*, by which a switch on state is established.

Figure 16:
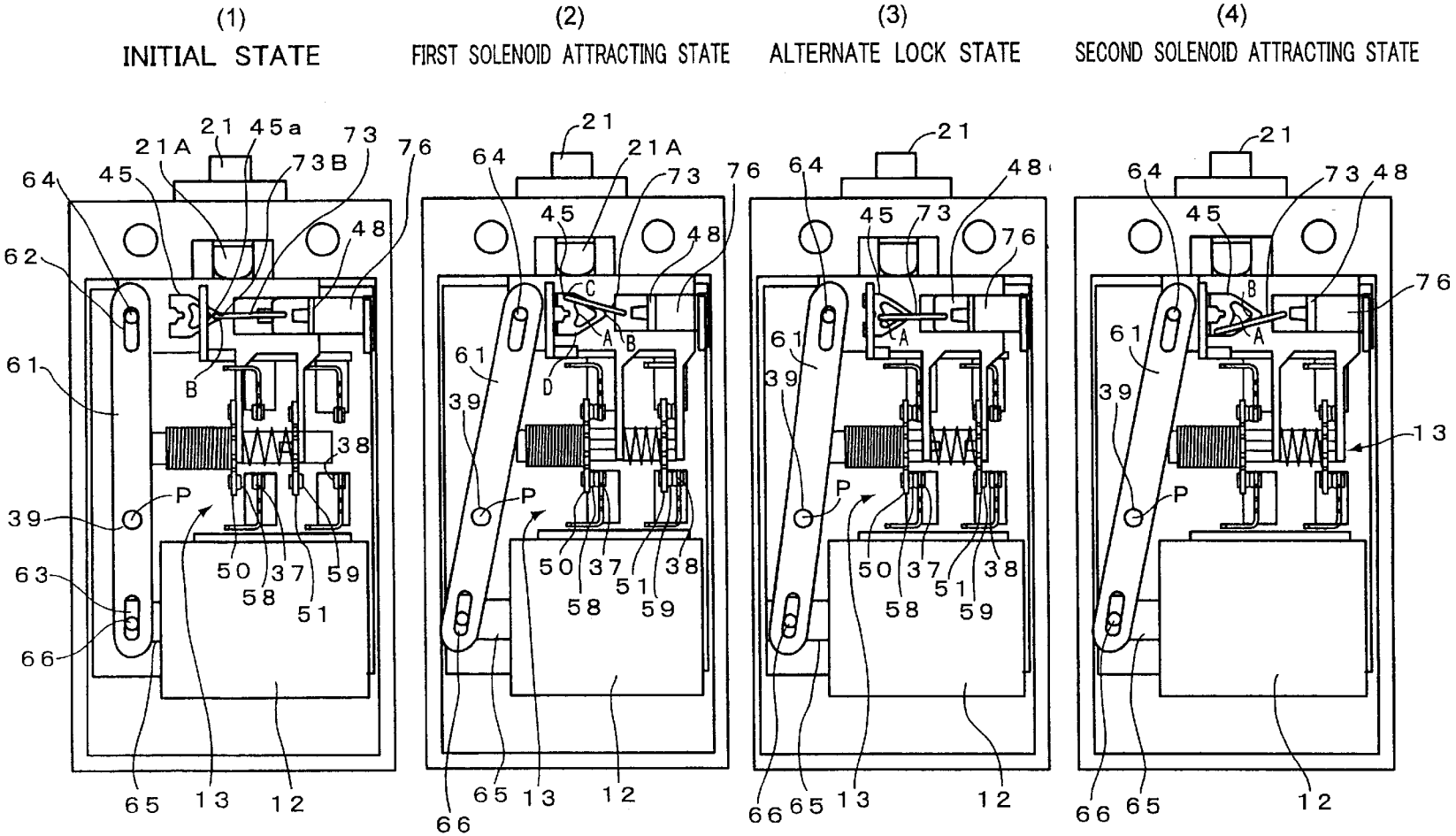
FIG. 16(1) is an explanatory view showing an initial state of a lock switch apparatus in accordance with the present invention.
Figure 17:
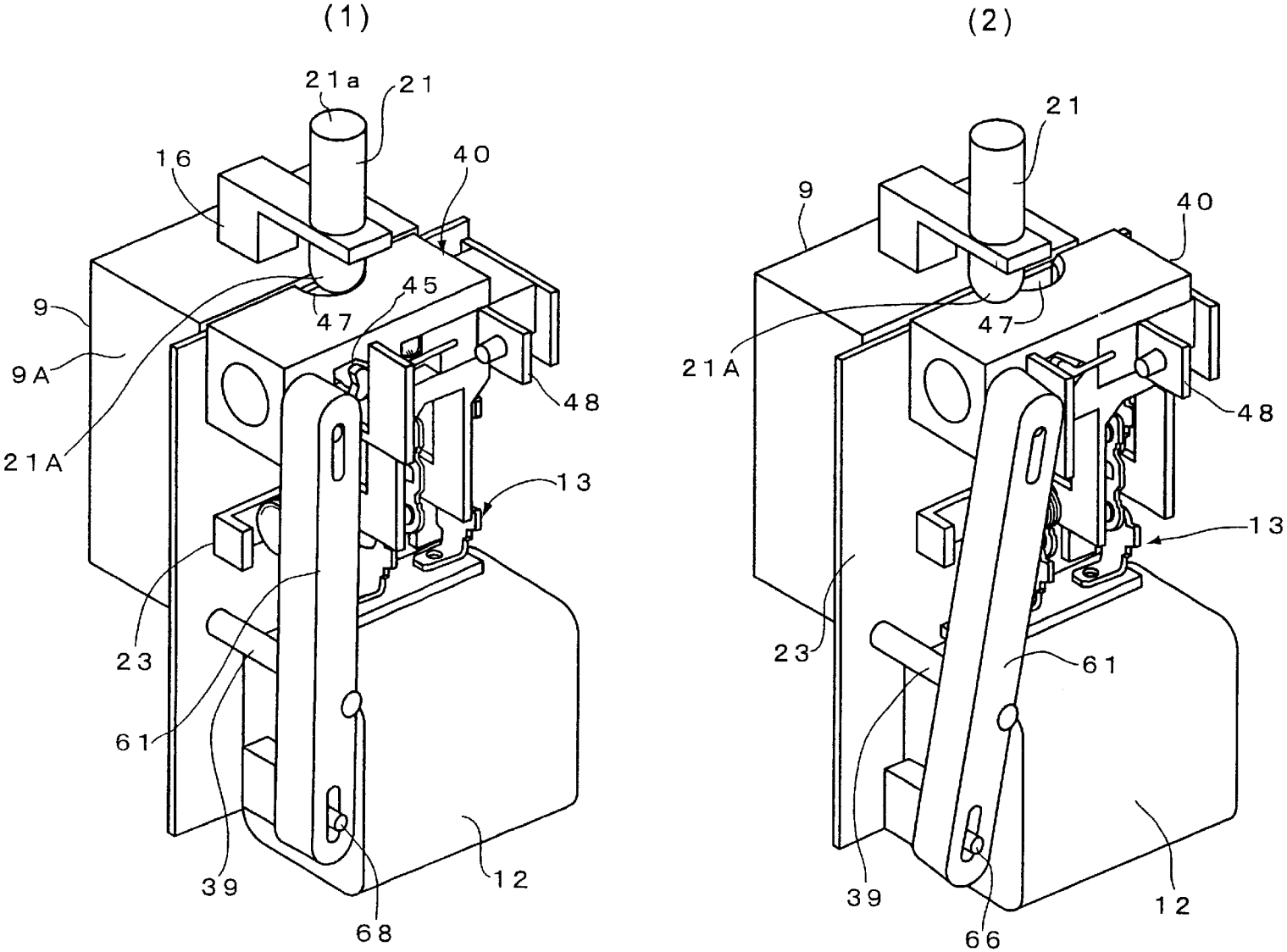
FIG. 17(1) is a perspective view, partially omitted, showing an initial state of a lock switch apparatus in accordance with the present invention.
Figure 18:
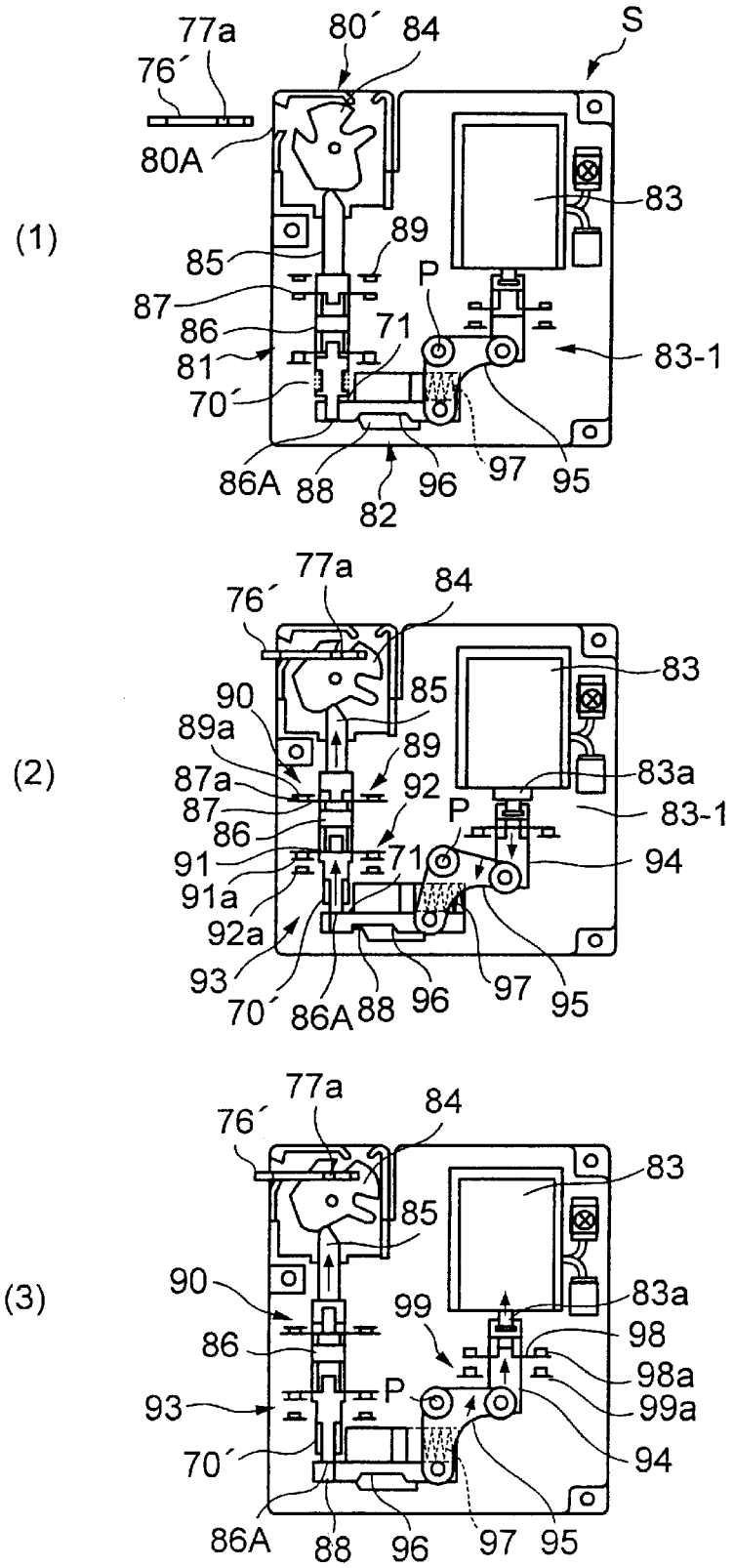
FIG.18 (PRIOR ART)
FIGS. 18(1), 18(2) and 18(3) are explanatory views of the operation of a conventional lock switch apparatus of a mechanical lock type.
Figure 19:
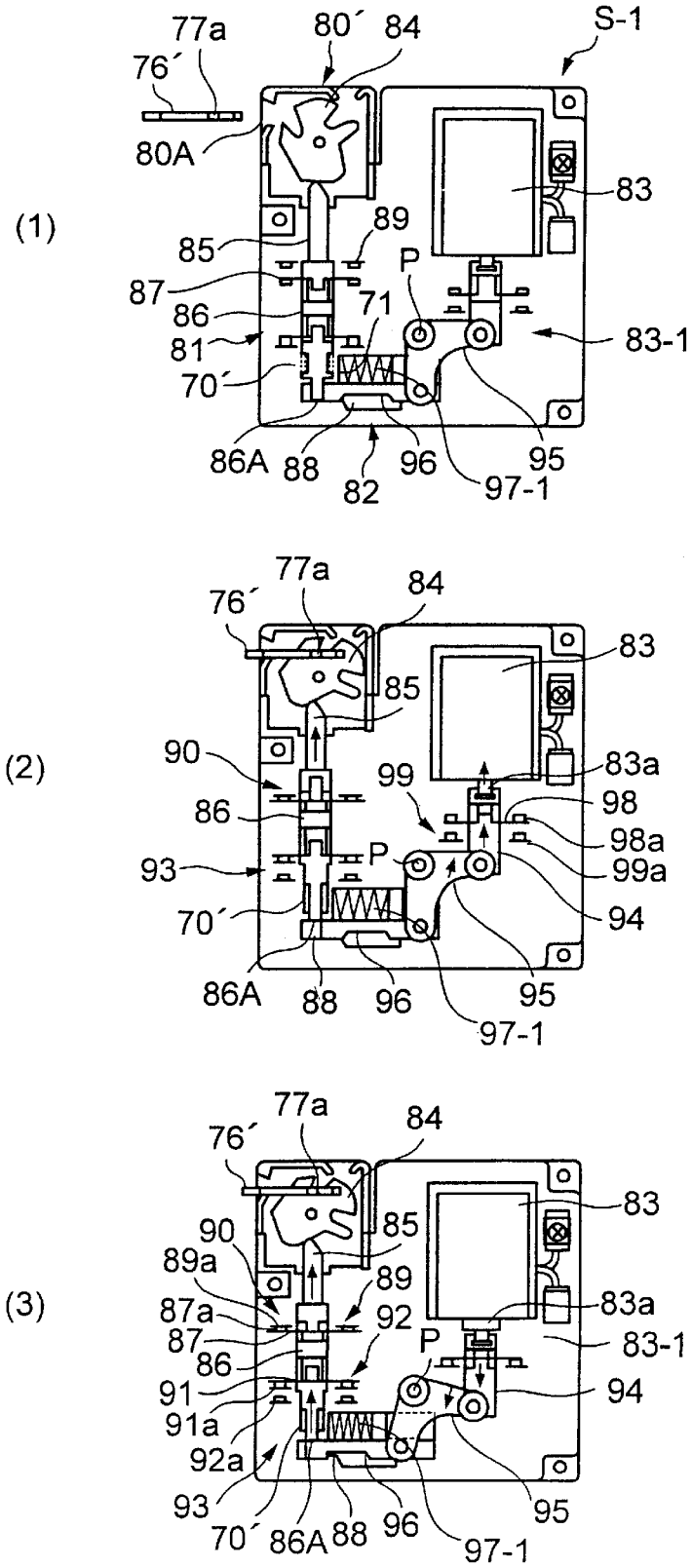
FIG.19 (PRIOR ART)
FIGS. 19(1), 19(2) and 19(3) are explanatory views of the operation of a conventional lock switch apparatus of a solenoid lock type.

Also, the solenoid 12 is energized, and the operation rod 65 is pulled out against the spring force of the spring member 67 for solenoid by an attraction. Therefore, as shown in FIGS. 16(2) and 17(2), the slide lock member 40 is moved to the right via the lever 61, and the engagement recess 47 provided in the slide lock member 40 shifts from the notch 34 in the base member 23. The locking protrusion 21A of the plunger 16 comes into contact with the ceiling 26 of the slide lock member 40, so that the plunger 16 is locked.

In this solenoid attracting state, the bent portion 73B on the left-hand side of the lock pin 73 is positioned at in a right upper portion C of the groove cam 45 by the rightward movement of the slide lock member 40.

Also, in this solenoid attracting state, the balance between the operating forces applied to the movable system is maintained by the vibration/impact absorbing means. Therefore, when a vibration or impact is applied to the lock switch apparatus, the movable system does not move, and a malfunction of switch signal due to an inertia force of the movable system, especially, the solenoid-side movable portion of the solenoid 12 is prevented.

Also, in the first solenoid attracting state, in the lock detection unit 13, the first movable contact 58 of the first movable element 50 is brought into contact with the first fixed contact 37, and the second movable contact 59 of the second movable element 51 is brought into contact with the second fixed contact 38 by the rightward movement of the slide lock member 40, so that the energized solenoid 12, that is, the locked state is detected.

(Alternate Lock State)

Next, by shutting off the current to the solenoid 12, as shown in FIG. 16(3), the operation rod 65 is pulled in by the operation of the spring force of the spring member 67 for solenoid. Thereupon, the slide lock member 40 is moved to the left via the lever 61, and the bent portion 73B on the left-hand side of the lock pin 73 is held at the first stationary point A of the groove cam 45.

Also, in this alternate lock state, the balance of the operating forces applied to the movable system is maintained by the vibration/impact absorbing means. Therefore, when a vibration or impact is applied to the lock switch apparatus, the movable system does not move, and a malfunction of switch signal due to an inertia force of the movable system, especially, the solenoid-side movable portion of the solenoid 12 is prevented.

In this alternate lock state, in the solenoid detection switch unit 13, the first movable contact 58 of the first movable element 50 is brought into contact with the first fixed contact 37, and the second movable contact 59 of the second movable element 51 is separated from the second fixed contact 38 by slight leftward movement of the slide lock member 40. Therefore, the state of the solenoid 12 that is distinguished from the first solenoid attracting state is detected.

In this alternate lock state, that is, in a mechanically locked state, power consumption during the operation of the apparatus can be eliminated, which contributes to power saving of the whole system. Also, the influence of deterioration in characteristics due to heat of the solenoid 12 can be decreased, so that a switch with high reliability can be provided by being operated in a superior characteristic zone.

(Second Solenoid Attracting State)

Next, in order to return the state to the initial one, the solenoid is energized, by which the operation rod 65 is pulled out against the spring force of the spring member 67 for solenoid by an attraction. As a result, the slide lock member 40 is moved to the right via the lever 61, so that the bent portion 73B on the left-hand side of the lock pin 73 comes off from the first stationary point A of the groove cam 45, and is positioned in a right lower portion D of the groove cam 45.

In this state, when the current to the solenoid 12 is shut off, the operation rod 65 is pulled in by the action of the spring force of the spring member 67 for solenoid, so that the slide lock member 40 is moved to the left via the lever 61. Therefore, the state is returned to the initial one, and the bent portion 73B on the left-hand side of the lock pin 73 is held at the second stationary point B of the groove cam 45. Also, the engagement recess 47 provided in the slide lock member 40 is caused to coincide with the notch 34 of the base member 23 by the leftward movement of the slide lock member 40.

When the operation key 2 is removed, that is, when the door is opened in a state in which the door can be opened, and the operation key 2 is removed, the cam 8 is turned and returned to the initial position, and the plunger 16 is moved downward against the spring member 17. Therefore, the locking protrusion 21A of the plunger 16 engages with the engagement recess 47 so as to be releasable from the notch 34, and the state returns to one shown in FIG. 16(1). Thereby, the activating portion 10*a* of the plunger 16 is pressed down, so that the movable element 18*a* is separated from the fixed contact 19*c*, and the movable element 18*b* comes into contact with the fixed contact 19*d*, by which a switch off state is established.

(Compulsory Unlock) When the lock is released and the state is returned from the alternate lock state to the initial one artificially without energizing the solenoid 12, the compulsorily unlocking mechanism 76 shown in FIGS. 14 and 15 is activated.

Specifically, a Phillips screwdriver (not shown) is inserted in the plus sign-shaped groove 79 in the center of the disk 78 to turn the semi-circular cam member 77, by which the movable element 68 whose cam receiving face 72 is circumscribed by the cam member 77 is pressed to the left against the spring member 75, so that the bent portion 73B on the left-hand side of the lock pin 73 comes off from the first stationary point A of the groove cam 45, and is positioned in the right lower portion D of the groove cam 45. Therefore, the operation rod 65 is pulled in by the action of the spring force of the spring member 67 for solenoid, so that the slide lock member 40 is moved to the left via the lever 61, by which the initial state is established.

In the above-described embodiment, the solenoid 12 is provided with the spring member 67 for solenoid that operates so as to pull in the operation rod 65 at the de-energized time, and the initial state of the lock switch apparatus is determined by the spring force of the spring member 67 for solenoid. However, the configuration may be such that the spring member 67 for solenoid is eliminated, and a spring member for urging the slide lock member 40 to the left is disposed, by which the initial state of the lock switch apparatus is determined by the spring force of this spring member.

As described above, according to the lock switch apparatus in accordance with the present invention, the plunger can be locked by moving the slide lock member at the ratio of lever with respect to the operation of the solenoid-side movable portion due to the attraction of the solenoid. Therefore, the slide lock member can be moved by using the solenoid-side movable portion in a zone in which the attraction of the solenoid is large.

Thereupon, a small-sized solenoid can be used, so that the outside size of the lock switch apparatus can be decreased, whereby a switch capable of being handled easily by the user can be realized.

The balance of the operating forces applied to the movable system is maintained by the vibration/impact absorbing means. Therefore, when a vibration or impact is applied to the lock switch apparatus, the movable system does not move, and a malfunction of switch signal due to an inertia force of the movable system, especially, the solenoid-side movable portion of the solenoid can be prevented.

Also, according to the lock switch apparatus in accordance with the present invention, the alternate lock state, that is, the mechanically locked state can be established. Therefore, power consumption during the operation of the apparatus can be eliminated, which contributes to power saving of the whole system. Also, the influence of deterioration in characteristics due to heat of the solenoid can be decreased, so that a switch with high reliability can be provided by being operated in a superior characteristic zone.

What is claimed is:

1. A lock switch apparatus comprising:

a key insertion unit;

a detection switch unit for detecting the insertion of an operation key in said key insertion unit;

a lock unit for locking said operation key when said operation key is inserted in said key insertion unit; and a lock detection unit for detecting the operation state of said lock unit, wherein said detection switch unit has a plunger that is moved by the insertion of said operation key in said key insertion unit to operate a switch element, said lock unit has a slide lock member for locking said plunger, a straight lever having a turning center in an intermediate portion thereof, and a solenoid which is arranged in parallel to said slide lock member and is engaged with said slide lock member through said straight lever, wherein said slide lock member is moved in parallel to the direction of operating said solenoid by turning said straight lever in response to the operation of said solenoid.

2. The lock switch apparatus according to claim 1, wherein said lock unit has a lock holding force securing means for mechanically holding and securing a lock holding force of said lock unit without dependence on an operating force of said solenoid.

3. The lock switch apparatus according to claim 2, wherein stationary points of said slide lock member at the time when said solenoid is de-energized are provided as a first stationary point and a second stationary point, and said lock holding force securing means is constructed of an alternate mechanism in which said stationary points are changed over alternately when said solenoid is turned on or off, wherein a lock state of said lock unit is established when said slide lock member is stayed at said first stationary point, and an unlock state of said lock unit is established when said slide lock member is stayed at said second stationary point.

4. The lock switch apparatus according to claim 2, wherein said lock unit has a compulsorily unlocking means for mechanically releasing the lock holding force of said lock unit caused by the lock holding force securing means without dependence on an operating force of said solenoid.

5. The lock switch apparatus according to claim 2, wherein said lock detection unit carries out the detection of an operating state of said lock unit by making a distinction between a lock state of said lock unit caused by an operating force of said solenoid and a lock state of said lock unit caused by the lock holding force securing means.

6. The lock switch apparatus according to claim 1, wherein a base member on which said detection switch unit, said lock unit, and said lock detection unit are disposed is constructed of at least two surfaces, wherein said detection switch unit is disposed on one surface, while said lock unit and said lock detection are disposed on the other surface of said base member.

7. A lock switch apparatus comprising:

a key insertion unit;

a detection switch unit for detecting the insertion of an operation key in said key insertion unit;

a lock unit for locking said operation key when said operation key is inserted in said key insertion unit; and a lock detection unit for detecting the operation state of said lock unit, wherein said lock unit has an associatively movable portion that locks said operation key, a straight lever having a turning center in an intermediate portion thereof, a solenoid-side movable portion which is arranged in parallel to said associatively movable portion and is engaged with said associatively movable portion through said straight lever, and a solenoid for operating said solenoid-side movable portion, wherein the turning center of the straight lever is selected such that an operating force applied to said associatively movable portion and an operating force applied to said solenoid-side movable portion are kept in equilibrium.

8. The lock switch apparatus according to claim 7, wherein said associatively movable portion includes a slide lock member which moves in parallel to the operating direction of the solenoid-side movable portion depending on the turning of said straight lever with respect to the operation of said solenoid-side movable portion.

9. A lock switch apparatus comprising:

a key insertion unit;

a detection switch unit for detecting the insertion of an operation key in said key insertion unit;

a lock unit for locking said operation key when said operation key is inserted in said key insertion unit; and a lock detection unit for detecting the operation state of said lock unit, wherein said detection switch unit has a plunger that is moved by the insertion of said operation key in said key insertion unit to operate a switch element, said lock unit has a slide lock member for locking said plunger, a straight lever having a turning center in an intermediate portion thereof, a solenoid which is engaged with said slide lock member through said straight lever, and a lock holding force securing means for mechanically holding and securing a lock holding force of said lock unit without dependence on an operating force of said solenoid, wherein said slide lock member is moved by turning said straight lever in response to the operation of said solenoid.

10. A lock switch apparatus comprising:

a key insertion unit;

a detection switch unit for detecting the insertion of an operation key in said key insertion unit;

a lock unit for locking said operation key when said operation key is inserted in said key insertion unit; and a lock detection unit for detecting an operation state of said lock unit, wherein said lock unit has an associatively movable portion that locks said operation key, a straight lever having a turning center in an intermediate portion thereof, a solenoid-side movable portion which is engaged with said associatively movable portion through said straight lever, a solenoid for operating said solenoid-side movable portion, and a lock holding force securing means for mechanically holding and securing a lock holding force of said lock unit without dependence on the operating force of said solenoid, wherein, the turning center of the straight lever is configured such that an operating force applied to said associatively movable portion and an operating force applied to said solenoid-side movable portion are selected so as to be kept in equilibrium.

11. The lock switch apparatus according to claim 10, wherein said associatively movable portion includes a slide lock member which moves depending on the turning of said straight lever with respect to the said solenoid-side movable portion.

12. The lock switch apparatus according to claim 9 or 11, wherein stationary points of said slide lock member at the time when said solenoid is de-energized are provided as a first stationary point and a second stationary point, and said lock holding force securing means is constructed of an alternate mechanism in which said stationary points are changed over alternately when said solenoid is turned on or off, wherein a lock state of said lock unit is established when said slide lock member is stayed at said first stationary point, and an unlock state of said lock unit is established when said slide lock member is stayed at said second stationary point.

13. The lock switch apparatus according to claim 9 or 10, wherein said lock unit has a compulsorily unlocking means for mechanically releasing the lock holding force of said lock unit caused by the lock holding force securing means without dependence on the operating force of said solenoid.

14. The lock switch apparatus according to claim 9 or 10, wherein said lock detection unit carries out the detection of an operating state of said lock unit by making a distinction between a lock state of said lock unit caused by an operating force of said solenoid and a lock state of said lock unit caused by the lock holding force securing means.

* * * * *